US008167003B1

(12) United States Patent
Clever et al.

(10) Patent No.: US 8,167,003 B1
(45) Date of Patent: May 1, 2012

(54) ORVR COMPATIBLE REFUELING SYSTEM

(75) Inventors: Bryan William Clever, Liberty Township, OH (US); B. Eric Riffle, Mason, OH (US)

(73) Assignee: Delaware Capital Formation, Inc., Wilmington, DE (US)

( * ) Notice: Subject to any disclaimer, the term of this patent is extended or adjusted under 35 U.S.C. 154(b) by 925 days.

(21) Appl. No.: 12/193,908

(22) Filed: Aug. 19, 2008

(51) Int. Cl.
*B65B 31/00* (2006.01)

(52) U.S. Cl. ..... 141/5; 141/198; 141/206; 141/214; 141/302; 141/307; 141/59; 141/8; 141/392

(58) Field of Classification Search ..... 141/59, 141/198, 302, 307, 308, 211, 214, 206, 392, 141/387
See application file for complete search history.

(56) References Cited

U.S. PATENT DOCUMENTS

| | | | |
|---|---|---|---|
| 1,998,221 | A | 4/1935 | Conklin |
| 3,323,560 | A | 6/1967 | Ehlers |
| 3,542,092 | A | 11/1970 | Budzak et al. |
| 3,548,893 | A | 12/1970 | Moore |
| 3,638,689 | A | 2/1972 | Eklund |
| 3,763,901 | A | 10/1973 | Viland |
| 3,768,777 | A | 10/1973 | Hechler, IV |
| 3,811,486 | A | 5/1974 | Wood |
| 3,815,327 | A | 6/1974 | Viland |
| 3,899,009 | A | 8/1975 | Taylor |
| 3,982,571 | A | 9/1976 | Fenton et al. |
| 4,056,131 | A | 11/1977 | Healy |
| 4,057,085 | A | 11/1977 | Shihabi |
| 4,057,086 | A | 11/1977 | Healy |
| 4,059,135 | A | 11/1977 | Hansel |
| 4,095,626 | A | 6/1978 | Healy |
| 4,121,635 | A | 10/1978 | Hansel |
| 4,133,355 | A | 1/1979 | Mayer |
| 4,258,760 | A | 3/1981 | Moore |
| 4,286,635 | A | 9/1981 | McMath |
| 4,336,830 | A | 6/1982 | Healy |
| 4,343,337 | A | 8/1982 | Healy |
| 4,372,353 | A | 2/1983 | Weas |
| 4,429,725 | A | 2/1984 | Walker et al. |

(Continued)

FOREIGN PATENT DOCUMENTS

| | | |
|---|---|---|
| DE | 664133 | 8/1938 |

(Continued)

OTHER PUBLICATIONS

"Workshop—Vapor Recovery Procedures," California Environmental Protection Agency, Air Resources Board (Oct. 6, 1997).

(Continued)

*Primary Examiner* — Timothy L Maust
*Assistant Examiner* — Timothy Kelly
(74) *Attorney, Agent, or Firm* — Thompson Hine LLP

(57) ABSTRACT

A refueling system including a nozzle configured to dispense fuel through a fuel path thereof into a vehicle tank. The nozzle includes a vapor path configured such that vapor recovered from the vehicle tank during refueling is passable therethrough. The system further includes a sensing valve disposed in the vapor path, wherein the sensing valve is configured to generally block the associated part of the vapor path when a sufficient vacuum from the vehicle tank is applied to the sensing valve during refueling. The system also includes a regulator valve disposed in the vapor path and arranged in series with the sensing valve, the regulator valve being configured to regulate the level of vacuum applied by a vapor pump to the sensing valve.

30 Claims, 8 Drawing Sheets

U.S. PATENT DOCUMENTS

| | | | | | |
|---|---|---|---|---|---|
| 4,450,879 | A | | 5/1984 | Wood | |
| 4,469,149 | A | | 9/1984 | Walkey et al. | |
| 4,497,350 | A | | 2/1985 | Guertin | |
| 4,809,753 | A | | 3/1989 | Finc, Jr. | |
| 4,838,323 | A | | 6/1989 | Watts | |
| 4,887,578 | A | | 12/1989 | Woodcock et al. | |
| 5,035,271 | A | | 7/1991 | Carmack et al. | |
| 5,040,577 | A | | 8/1991 | Pope | |
| 5,053,774 | A | | 10/1991 | Schuermann et al. | |
| 5,134,875 | A | | 8/1992 | Jensen et al. | |
| 5,141,037 | A | | 8/1992 | Carmack et al. | |
| 5,147,328 | A | | 9/1992 | Dragosits et al. | |
| 5,165,379 | A | | 11/1992 | Thompson | |
| 5,174,346 | A | | 12/1992 | Healy | |
| 5,178,197 | A | | 1/1993 | Healy | |
| 5,197,523 | A | | 3/1993 | Fink, Jr. et al. | |
| 5,209,275 | A | | 5/1993 | Akiba et al. | |
| 5,213,142 | A | | 5/1993 | Koch et al. | |
| 5,249,612 | A | | 10/1993 | Parks et al. | |
| 5,273,087 | A | | 12/1993 | Koch et al. | |
| 5,285,744 | A | | 2/1994 | Grantham et al. | |
| 5,316,057 | A | | 5/1994 | Hasselmann | |
| 5,319,199 | A | | 6/1994 | Stedman et al. | |
| 5,327,944 | A | | 7/1994 | Healy | |
| 5,386,859 | A | | 2/1995 | Healy | |
| 5,390,712 | A | * | 2/1995 | Parrish et al. | 141/59 |
| 5,450,883 | A | | 9/1995 | Payne et al. | |
| 5,476,125 | A | | 12/1995 | Mitchell | |
| 5,507,325 | A | | 4/1996 | Finlayson | |
| 5,537,911 | A | | 7/1996 | Ohlrogge et al. | |
| 5,562,133 | A | | 10/1996 | Mitchell | |
| 5,592,963 | A | | 1/1997 | Bucci et al. | |
| 5,592,979 | A | | 1/1997 | Payne et al. | |
| 5,605,182 | A | | 2/1997 | Oberrecht et al. | |
| 5,620,031 | A | | 4/1997 | Dalhart et al. | |
| 5,626,649 | A | | 5/1997 | Nanaji | |
| 5,636,667 | A | | 6/1997 | Young et al. | |
| 5,655,576 | A | | 8/1997 | Leininger et al. | |
| 5,676,181 | A | | 10/1997 | Healy | |
| 5,678,614 | A | | 10/1997 | Grantham | |
| 5,720,325 | A | | 2/1998 | Grantham | |
| 5,765,603 | A | | 6/1998 | Healy | |
| 5,782,275 | A | | 7/1998 | Hartsell, Jr. et al. | |
| 5,803,136 | A | | 9/1998 | Hartsell, Jr. | |
| 5,843,212 | A | | 12/1998 | Nanaji | |
| 5,857,500 | A | | 1/1999 | Payne et al. | |
| 5,860,457 | A | | 1/1999 | Andersson | |
| 5,871,651 | A | | 2/1999 | McSpadden | |
| 5,944,067 | A | | 8/1999 | Andersson | |
| 5,988,232 | A | | 11/1999 | Koch et al. | |
| 5,992,395 | A | | 11/1999 | Hartsell, Jr. et al. | |
| 6,026,866 | A | | 2/2000 | Nanaji | |
| 6,059,856 | A | | 5/2000 | Ohlrogge et al. | |
| 6,070,156 | A | | 5/2000 | Hartsell, Jr. | |
| 6,082,415 | A | | 7/2000 | Rowland et al. | |
| 6,095,204 | A | | 8/2000 | Healy | |
| 6,102,085 | A | | 8/2000 | Nanaji | |
| 6,103,532 | A | | 8/2000 | Koch et al. | |
| 6,123,118 | A | | 9/2000 | Nanaji | |
| 6,151,955 | A | | 11/2000 | Ostrowski et al. | |
| 6,180,922 | B1 | | 1/2001 | Rohner et al. | |
| 6,332,483 | B1 | | 12/2001 | Healy | |
| 6,334,470 | B2 | | 1/2002 | Healy | |
| 6,532,999 | B2 | | 3/2003 | Pope et al. | |
| 6,810,922 | B1 | | 11/2004 | Grantham | |
| 7,174,926 | B1 | | 2/2007 | Grantham | |
| 7,509,982 | B2 | * | 3/2009 | Grantham | 141/59 |
| 7,987,878 | B1 | * | 8/2011 | Imler | 141/59 |
| 2007/0193648 | A1 | | 8/2007 | Grantham | |

FOREIGN PATENT DOCUMENTS

| | | |
|---|---|---|
| DE | 1097775 | 1/1961 |
| DE | 4413302 | 10/1995 |
| EP | 0653376 | 5/1995 |
| GB | 2206561 | 1/1989 |
| GB | 2311768 | 10/1997 |
| WO | 97/34805 | 9/1997 |
| WO | 97/44274 | 11/1997 |

OTHER PUBLICATIONS

"Vapor Recovery Test Procedure," California Environmental Protection Agency, Air Resources Board (Oct. 6, 1997).

OPW Fueling Components Brochure entitled, "ORVR/Stage II Compatibility: Keeping Onboard and Vac-Assist Systems From Pulling in Opposite Directions" (Prior to Dec. 18, 1998).

Gilbarco Inc. literature, "VaporVac Vacuum Assist Vapor Recovery" (Prior to Dec. 18, 1998).

Chrysler Corporation literature, "Integrated Refueling/Evaporative Emissions Control System with Liquid Seal Refueling Vapor Control" (Prior to Dec. 18, 1998).

California Air Resources Board Workshop Notice, Mail Out #94-08 (Feb. 9, 1994).

California Air Resources Board, Mail Out #94-23 regarding Staffs Proposed Recommendation for the Adoption of the United States Environmental Protection Agency's Vehicle Refueling Standard and Test Procedures (May 27, 1994).

* cited by examiner

ORVR COMPATIBLE REFUELING SYSTEM

The present invention is directed to a refueling system, and more particularly, to a refueling system which is compatible with vehicles having onboard refueling vapor recovery systems.

BACKGROUND

At a typical refueling station, fuel (such as gasoline, diesel, biofuels, blended fuels, or the like) is pumped from an underground storage tank through a fuel dispenser, a hose and associated nozzle to the vehicle fuel tank. As the fuel enters the vehicle fuel tank, hydrocarbon vapors from the fuel inside the tank are exhausted or forced out of the tank. Environmental laws and/or regulations require that vapors emitted from a vehicle fuel tank during refueling be captured and returned to the underground fuel storage tank. For example, stage II vacuum assist vapor recovery systems (i.e. vapor recovery systems utilized during vehicle refueling) may be required to capture/recover a certain percentage (such as 95%) of the fuel vapor that is exhausted from the vehicle tank during refueling. The captured vapor is returned through the vapor path of the nozzle, hose, dispenser and underground piping system back to the ullage space of the underground fuel storage tank.

An ever-increasing number of vehicles include an onboard refueling vapor recovery ("ORVR") system configured to capture/reclaim the vapor emitted from the fuel tank during refueling. The ORVR system routes or feeds the vapor to a capture canister which includes activated carbon. Once the refueling process is complete and the vehicle engine is running, vapor in the capture canister is routed into the engine where the vapors are burned during the combustion process. The ORVR system is also vented so that the pressure in the vehicle fuel tank is maintained at or near atmospheric pressure.

A liquid seal ORVR system (the most common ORVR system) is typically designed such that the vehicle fill pipe leading to the vehicle fuel tank has a progressively reduced inner diameter. This configuration ensures that fuel flowing into the fill pipe covers or extends continuously across the cross section of the fill pipe during refueling to form a liquid seal, which prevents fuel vapor from escaping through the fill pipe. The reduction in diameter of the fill pipe also causes a vacuum to be generated during refueling due to the venturi effect. The phenomemon, known as an injector effect, draws surrounding air/vapor into the fuel flow stream, and creates a positive pressure in the vehicle fuel tank that forces the vapors into the vapor capture canister carried on the vehicle.

When a vehicle equipped with an ORVR system (i.e. an ORVR vehicle) is refueled by a dispenser with a vacuum assist vapor recovery system, the ORVR system collects the vapor from the vehicle fuel tank, thereby preventing the vapor from being collected by the vapor recovery system. Accordingly, since the vapor recovery system of the refueling station may continue to operate, the vapor recovery system could, instead of vapor, draw in fresh air surrounding the vehicle/nozzle interface and route the ingested fresh air to the ullage space of the underground storage tank. The introduction of excessive fresh air into the underground storage tank increases the evaporation of the liquid fuel stored in the underground storage tank. This increase in vapor, or vapor growth, in the underground storage tank causes the tank to become pressurized so that polluting fuel vapors escape the tank and are released into the atmosphere. Accordingly, the incompatibility between an ORVR system and a vacuum assist vapor recovery system can increase the hydrocarbon pollutants and reduce the overall effectiveness of each system.

Some vacuum assist vapor recovery nozzles may use a vapor boot or bellows which surrounds the end of the nozzle spout and contacts the fill pipe/body of the vehicle to contain vapors. In addition, many nozzles may utilize a shutoff sensor/opening positioned at or near the end of the nozzle spout. When the shutoff sensor is covered by foam or splash-back of the liquid fuel, the shutoff sensor triggers an automatic shutoff of the nozzle. Refueling systems that utilize a vapor boot and a shutoff sensor can experience nuisance or premature automatic shutoffs due to the vacuum generated by the liquid seal ORVR system. In particular, the vacuum created by an ORVR vehicle during refueling can trigger the shutoff sensor of the nozzle before the fuel tank is full. This requires the customer/operator to re-engage the nozzle, thereby adding wear and tear on the refueling components, and causing aggravation to the customer/operator.

Standard or non-ORVR vehicles (i.e. vehicles lacking an ORVR system) can also experience a temporary vacuum in the vehicle tank fill pipe in a condition known as "vapor collapse." In particular, when the ullage space in the vehicle fuel tank is at a sufficiently elevated temperature and/or pressure, the vehicle may be considered to be a "hot" vehicle. When fuel from the underground storage tank is dispensed into the tank of a hot vehicle, the vapor in the hot vehicle tank is rapidly chilled by the cooler fuel, thereby correspondingly reducing the pressure in the ullage space of the vehicle fuel tank. As the vapor in the vehicle tank shrinks, a negative pressure or vacuum is created in the vehicle tank ullage space and fill pipe, resulting in vapor collapse.

Vapor collapse is typically a relatively brief event, and the reduced pressure caused by vapor collapse quickly dissipates as equilibrium is reached. However, many refueling systems include an ORVR sensor that can be activated by the temporary vacuum sensed in the fill pipe of the vehicle during vapor collapse. This, in turn, may cause the refueling system to block the recovery of vapor for the remainder of the refueling event. The failure to recover vapors during refueling allows the polluting vapors to escape into the atmosphere, and cause the refueling event to be non-compliant.

Moreover, when a refueling system incorrectly determines that a non-ORVR vehicle is an ORVR vehicle due to vapor collapse, the improper determination can cause the nozzle automatic shutoff mechanism to function improperly. In particular, in this case the refueling system blocks the vapor return path to the underground storage tank ullage space. When the vapor boot on the nozzle does not allow the vehicle ullage space to vent, pressure in the vehicle ullage space and vapor boot builds as fuel is dispensed and the vapor is trapped in the tank. The pressure could build to a point where the nozzle automatic shutoff mechanism will not function, which could cause the tank to overfill and fuel to spill on the ground.

SUMMARY

Accordingly, in one embodiment the invention is a refueling system which is designed to improve compatibility with vehicles having ORVR systems. In particular, in one embodiment the invention is a refueling system including a nozzle configured to dispense fuel through a fuel path thereof into a vehicle tank. The nozzle includes a vapor path configured such that vapor recovered from the vehicle tank during refueling is passable therethrough. The system further includes a sensing valve disposed in the vapor path, wherein the sensing valve is configured to generally block the associated part of the vapor path when a sufficient vacuum from the vehicle tank is applied to the sensing valve during refueling. The system also includes a regulator valve disposed in the vapor path and arranged in series with the sensing valve, the regulator valve being configured to regulate the level of vacuum applied by a vapor pump to the sensing valve.

DETAILED DESCRIPTION

Figure 1:
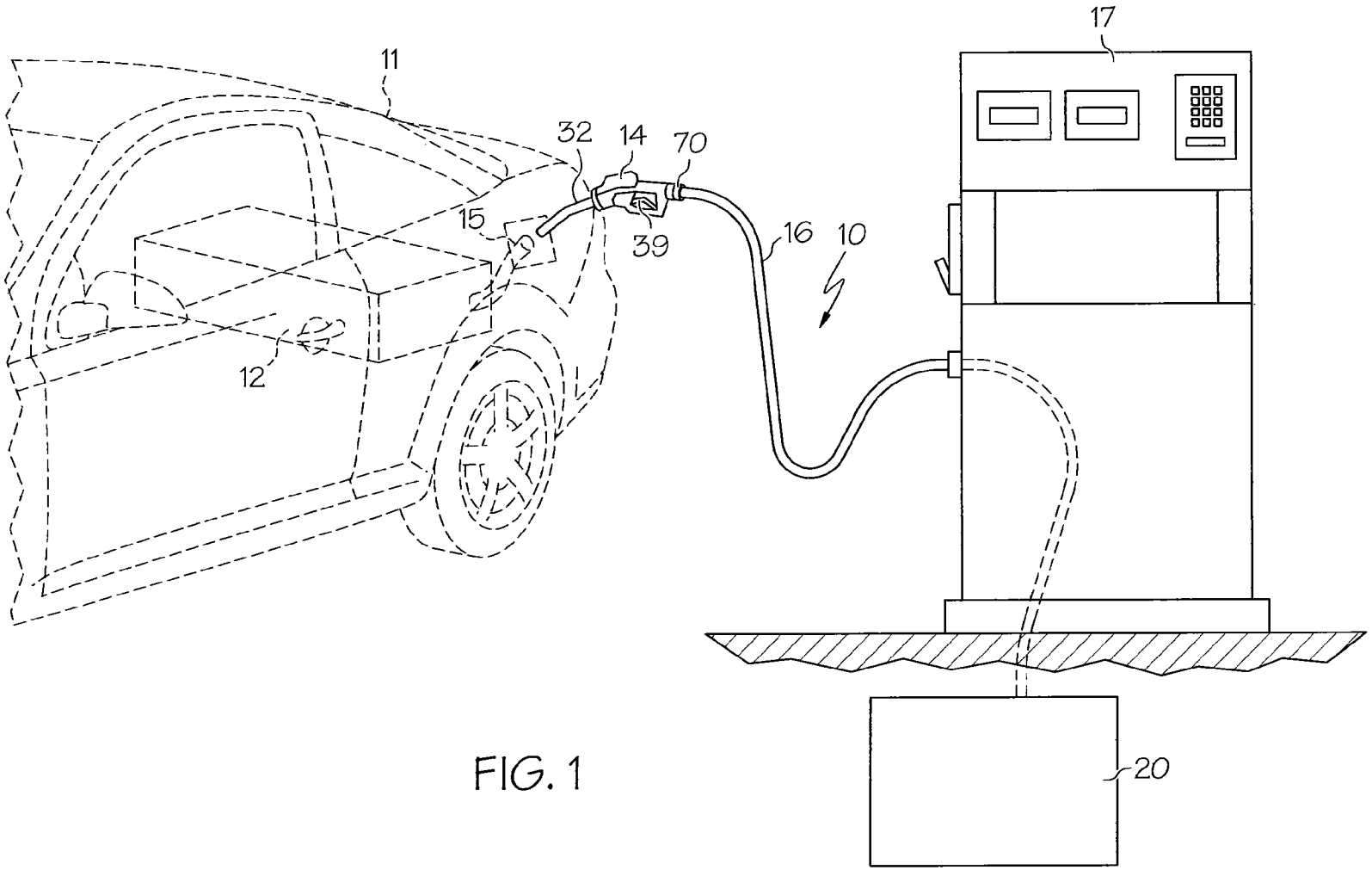
FIG. 1 is a schematic representation of a refueling system in conjunction with an automobile to be refueled.

FIG. 1 is a schematic representation of a refueling system 10 refueling a vehicle 11 having a fuel tank 12. A nozzle or dispenser body 14 is inserted into the fill pipe 15 of the vehicle fuel tank 12, and fuel is pumped from the underground fuel storage tank 20 to the nozzle 14 and into the vehicle fuel tank 12 via a hose 16. The hose 16 may be coupled to an automotive fuel dispenser or the like 17, and the nozzle 14 is mountable on the fuel dispenser 17 when the nozzle 14 is not in use.

Figure 2:
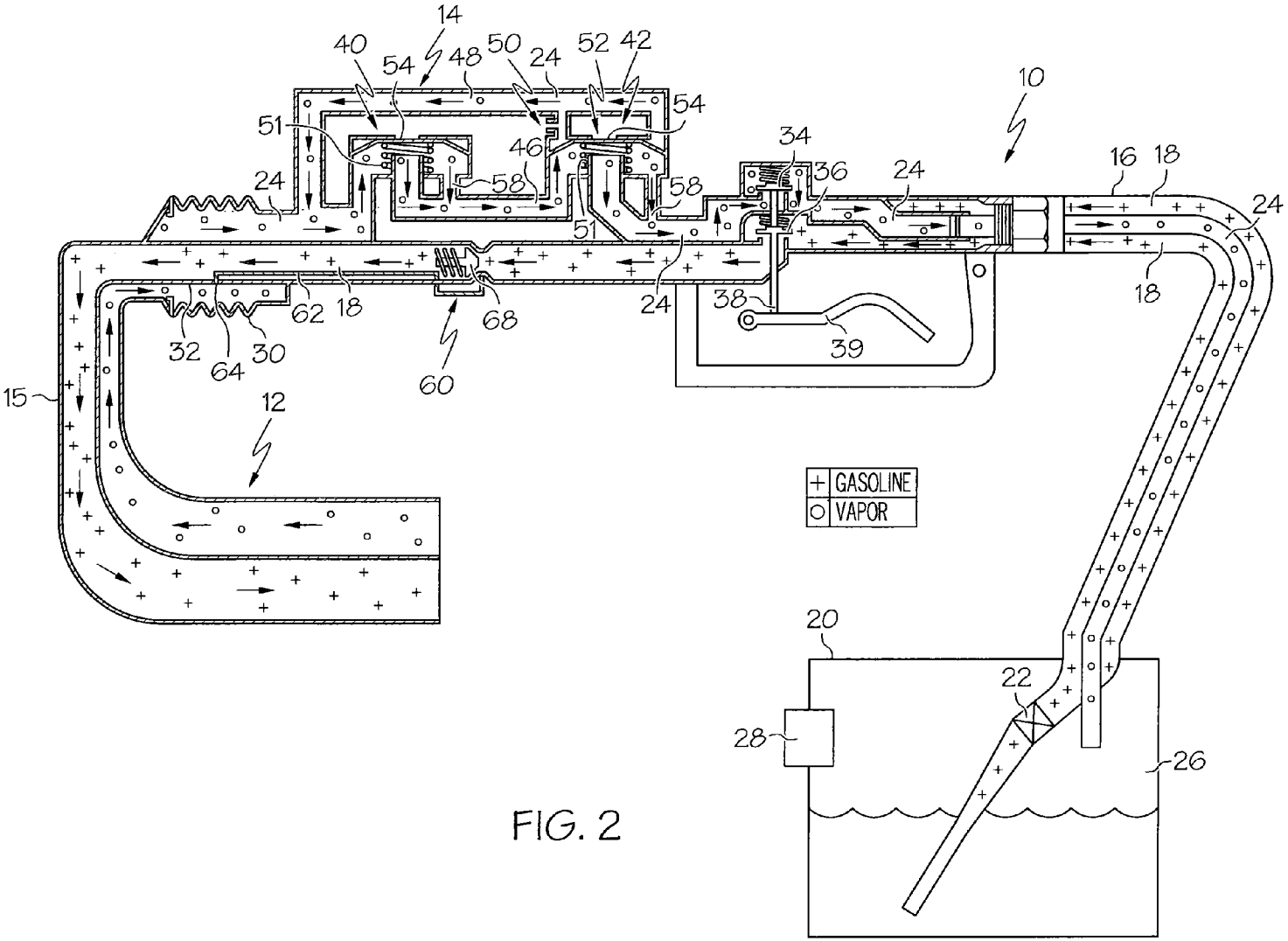
FIG. 2 is schematic representation of one embodiment of a refueling system of the present invention when the refueling system is recovering vapors.
Figure 3:
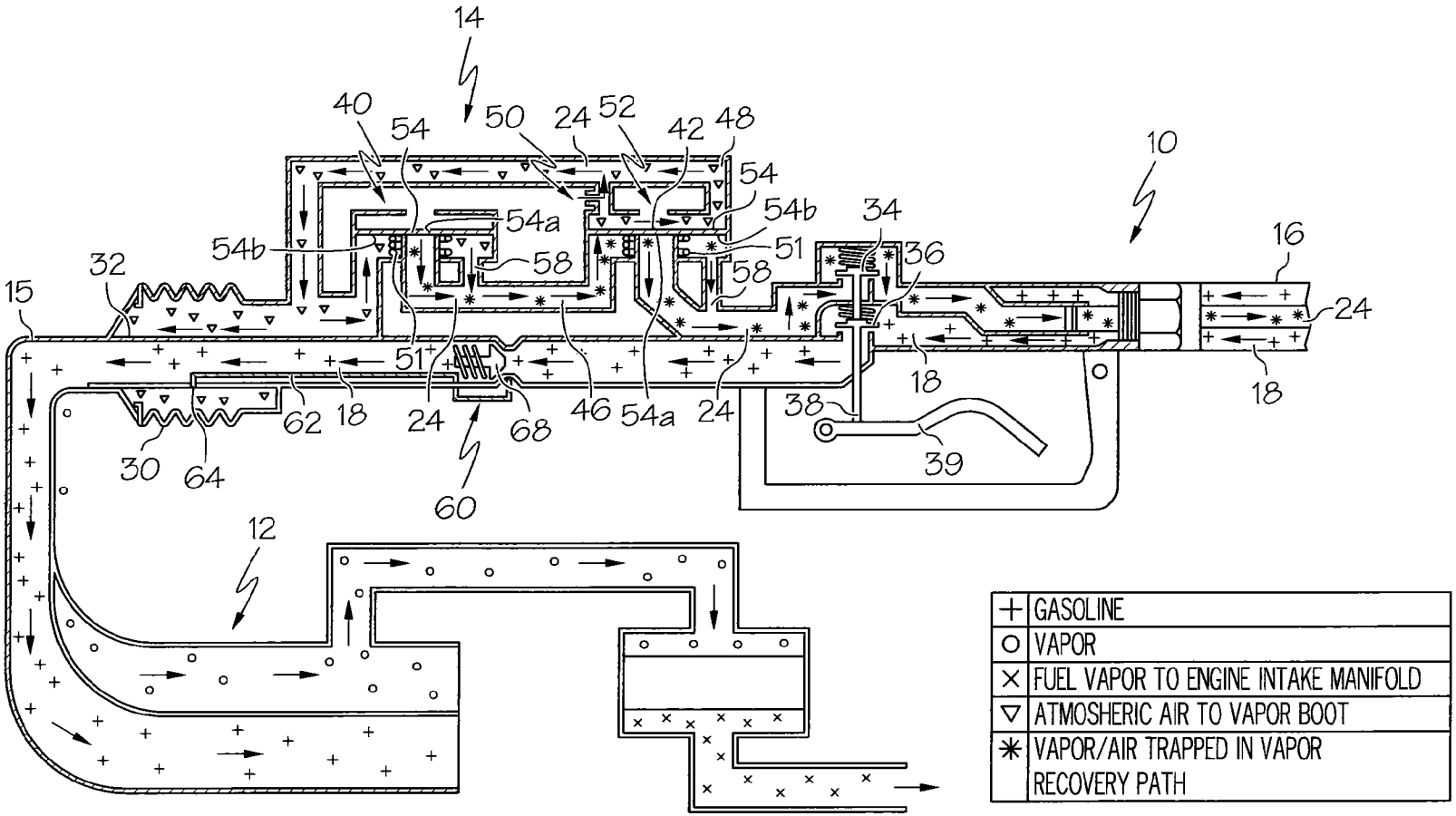
FIG. 3 is a schematic representation of the refueling system of FIG. 2 when the system is not recovering vapors.
Figure 4:
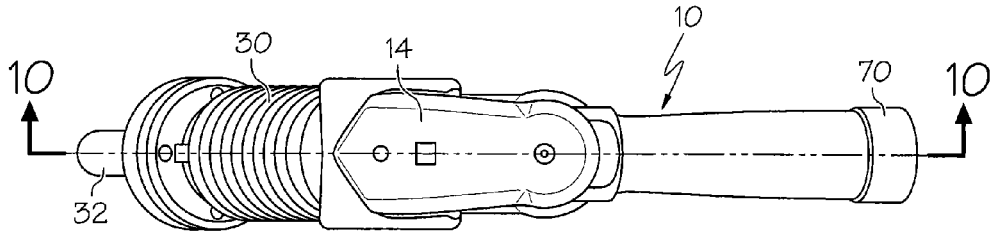
FIG. 4 is a top view of a nozzle incorporating one embodiment of the refueling system of the present invention.
Figure 5:
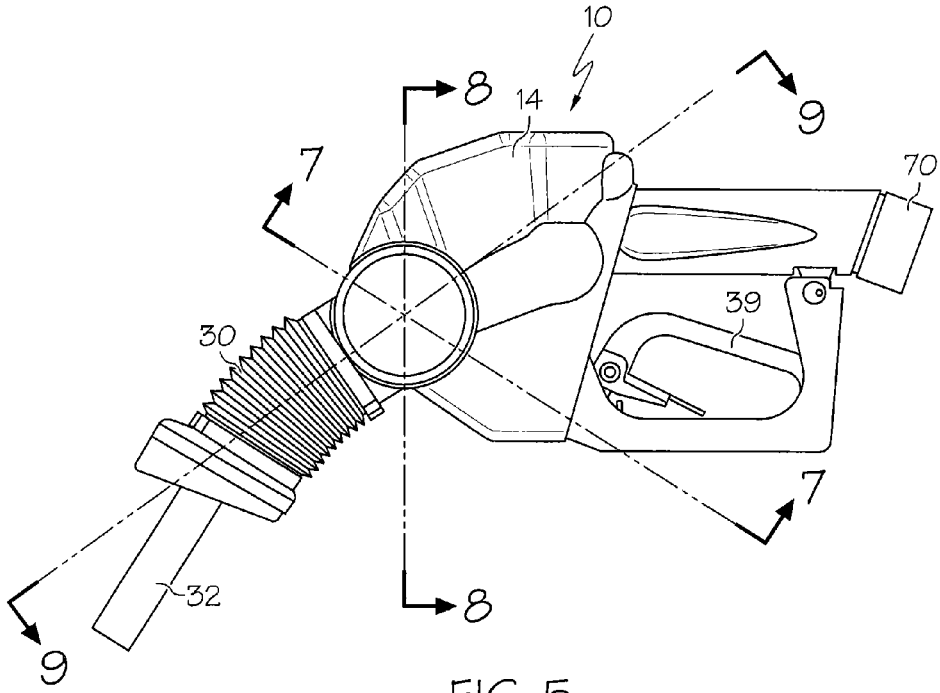
FIG. 5 is a side view of the nozzle of FIG. 4.

As shown in FIGS. 2 and 3, a fuel path 18 extends through the nozzle 14 and hose 16. The fuel path 18 is fluidly connected to the underground fuel storage tank 20 and/or fuel pump 22 at its distal end. Similarly, a vapor path 24 (or vapor recovery path) extends through the nozzle 14 and hose 16. The vapor path 24 fluidly communicates with the ullage space 26 of the underground storage tank 20 and/or a vapor pump 28. The vapor path 24 extends generally parallel to, but is fluidly isolated from, the fuel path 18. For example, in one embodiment the vapor path 24 is received within, and generally coaxial with, the fuel path 18 in the hose 16. However, this configuration may be reversed such that the fuel path 18 is received within the vapor path 24, or other configurations (i.e. side-by-side or the like) may be utilized.

The system 10 may include a flexible vapor boot or bellows 30 (not shown in FIG. 1) of the type well known in the art which is coupled to, and circumferentially surrounds, a spout 32. The bellows 30 help to capture vapors and route the vapors into the vapor path 24. In one embodiment, the boot/bellows 30 is generally continuous (i.e. lacks any significant holes/vents) to generally form a closed volume.

The refueling system 10 as shown in FIGS. 2 and 3 includes a main vapor valve 34 and a main fuel valve 36 commonly mounted on a shaft 38, which is in turn coupled to a handle/lever 39. The valve assemblies 34, 36 and handle/lever 39 are biased in their closed positions, thereby blocking fuel and vapor from traveling through the fuel path 18 and vapor path 24, respectively. When the lever 39 is gripped by a user/operator and pivoted upwardly, the main valve assemblies 34, 36 are correspondingly opened, thereby allowing the flow of fuel and vapor through the fuel 18 and vapor 24 paths, respectively. The main vapor valve 34 is configured to prevent the release of vapor from the underground storage tank 20 to atmosphere when the tank 20 is under a positive internal pressure. The main vapor valve 34 is also configured to prevent the ingestion of outside air when the underground tank 20 is under a sufficiently high negative internal pressure.

The system 10 includes an ORVR sensing valve 40 and a vacuum regulator valve 42 arranged in series in the vapor path 24. An intermediate portion or path 46 of the vapor path 24 extends between the valves 40, 42. In this manner the upstream portion of the sensing valve 40 is in fluid communication with the inner volume of the vapor boot 30, and the downstream end of the sensing valve 40 is in fluid communication with intermediate path 46 and the regulator valve 42 (the terms "upstream" and "downstream" are used with reference to the normal flow of vapor through the system during vapor recovery, as is indicated by the arrows in the vapor path 24 of FIG. 2). The upstream portion of the regulator valve 42 is in fluid communication with the intermediate path 46 and the sensing valve 40, and the downstream end of the regulator valve 42 is in fluid communication with the underground storage tank 20/vapor pump 28 via the hose 16. The sensing valve 40 and regulator valve 42 are both positioned upstream from the main vapor valve 34 to isolate those valves 40, 42 from the tank 20 when the main vapor valve 34 is closed, as will be described in greater detail below.

A vent path 48 may be provided adjacent to the regulator valve 42. The vent path 48 is fluidly coupled to the inner volume of the vapor boot 30 (also known as the bellows/fill pipe interface), and thereby to the upstream end of the sensing valve 40. The vent path 48 includes a constantly open vent 50 (i.e. the "primary vent") formed therein which is open to atmosphere. As will be described in greater detail below, the primary vent 50 helps to maintain the desired vacuum/pressure levels in the volume inside the vapor boot 30. The vent path 48 may also be fluidly coupled to a passive, always open secondary vent 52 positioned adjacent to the regulator valve 42. The always open secondary vent 52 is non-sealable such that it is also always open to ambient/atmosphere. Moreover, although the secondary vent 52 is a passive vent (i.e. is not directly controlled), the secondary vent can be influenced to be further opened by movement of the regulator valve 42, as described in greater detail below.

Both the sensing valve 40 and the regulator valve 42 may be diaphragm valves having an associated diaphragm 54 which is spring biased into an open position. One side (the lower side in FIGS. 2 and 3) of each diaphragm 54 is exposed to pressure in the vapor path 24, and the other side of the diaphragm 54 is generally exposed to ambient/atmosphere air. The sensing valve 40 may be closed at a lower pressure than that of the regulator valve 42; in other words, the sensing valve 40 may be spring-biased open with a weaker spring 51 (or preloaded force) than the spring 51 (or preloaded force) utilized in the regulator valve 42.

Moreover, each valve 40/42/diaphragm 54 may be configured to be exposed to two differing pressures on the same side of the diaphragm 54 when the valves 40, 42 are closed or nearly closed. For example, in one embodiment each diaphragm 54 is generally circular (although each diaphragm 54 may have differing shapes as desired). In this case, when the sensing valve 40 is closed (as shown in FIG. 3), the inner (central) surface 54*a* of the diaphragm 54 is exposed to the pressure/vacuum in the intermediate path 46, and the outer surface 54*b* of same side of the diaphragm 54 is exposed to the pressure in the vapor boot 30. Similarly, when the regulator valve 42 is closed, the inner/central surface area 54*a* of diaphragm 54 of the regulator valve 42 is exposed to the vacuum generated by the vapor pump 22, and the outer surface area 54*b* of the diaphragm 54 is exposed to the pressure/vacuum in the intermediate path 46.

The shapes and sizes of the inner 54*a*/outer 54*b* surfaces of each diaphragm 54 of each valve 40, 42 can be varied as desired to allow predetermined pressures to open and close the valves 40, 42 as desired. However, in one embodiment, the outer surface 54*b* of each diaphragm 54 has a larger surface area than the associated inner surface 54*a*. Accordingly, the outer surface 54*b* of each diaphragm 54 may be termed the "major surface" of the diaphragm 54, and the inner surface 54*a* may be termed the "minor surface."

It should also be noted that when the sensing valve 40 and regulator valves 42 are "closed," a perfect seal may not necessarily be formed. For example, the diaphragm 54 of the valves 40, 42 and/or their corresponding valve seat may be imperfectly matched or formed to allow some leaking across the valves 40, 42 even when the valves 40, 42 are closed, as schematically indicated by the leakage paths 58 shown in FIGS. 2 and 3. The leakage paths 58 can also be formed in any of a variety of other manners, such as machining leakage paths in the nozzle 14, etc. Moreover, it should be understood that the valves 40, 42 need not necessarily be diaphragm valves, and similar performance can be provided by various other valving or other arrangements.

The regulator valve 42 may generally influence or affect the passive, always open secondary vent 52 such that when the regulator valve 42 is closed (i.e. the regulator valve 42 generally isolates the intermediate path 46 from the vapor pump 28), the regulator valve 42 more fully opens the secondary vent 52. However, even when the regulator valve 42 is open, the always open secondary vent 52 is not fully closed. In particular, a cut-out, depression or drilled hole (see cut-out 53 of FIG. 9) may be formed in the upper contact of the valve 42 to ensure that the secondary vent 52 is always open.

Since the regulator valve 42 controls the flow of air/vapor through surrounding areas of the vapor path 46 and influence the passive, always open secondary vent 52, the regulator valve 42 can be considered a valve with dual functions. In particular, when the regulator valve 42 is "closed," the regulator valve 42 generally isolates the intermediate path 46 from the storage tank 20/vapor pump 28, (except for its associated leakage path 58), and more fully opens the always open secondary vent 52. Conversely, when the regulator valve 42 is "opened," the regulator valve 42 allows fluid communication between the intermediate path 46 and the storage tank 20/vapor pump 28, but reduces the entry of fresh air into the vent path 48 via the always open secondary vent 52. Furthermore, the regulator valve 42 can be located in various intermediate positions between the "open" and "closed" positions (as can the sensing valve 40). The always open secondary vent 52 ensures that there is a pressure differential on both sides of the diaphragm 54 of the regulator valve 42 in order to induce the closing motion of the valve 42.

Figure 10:
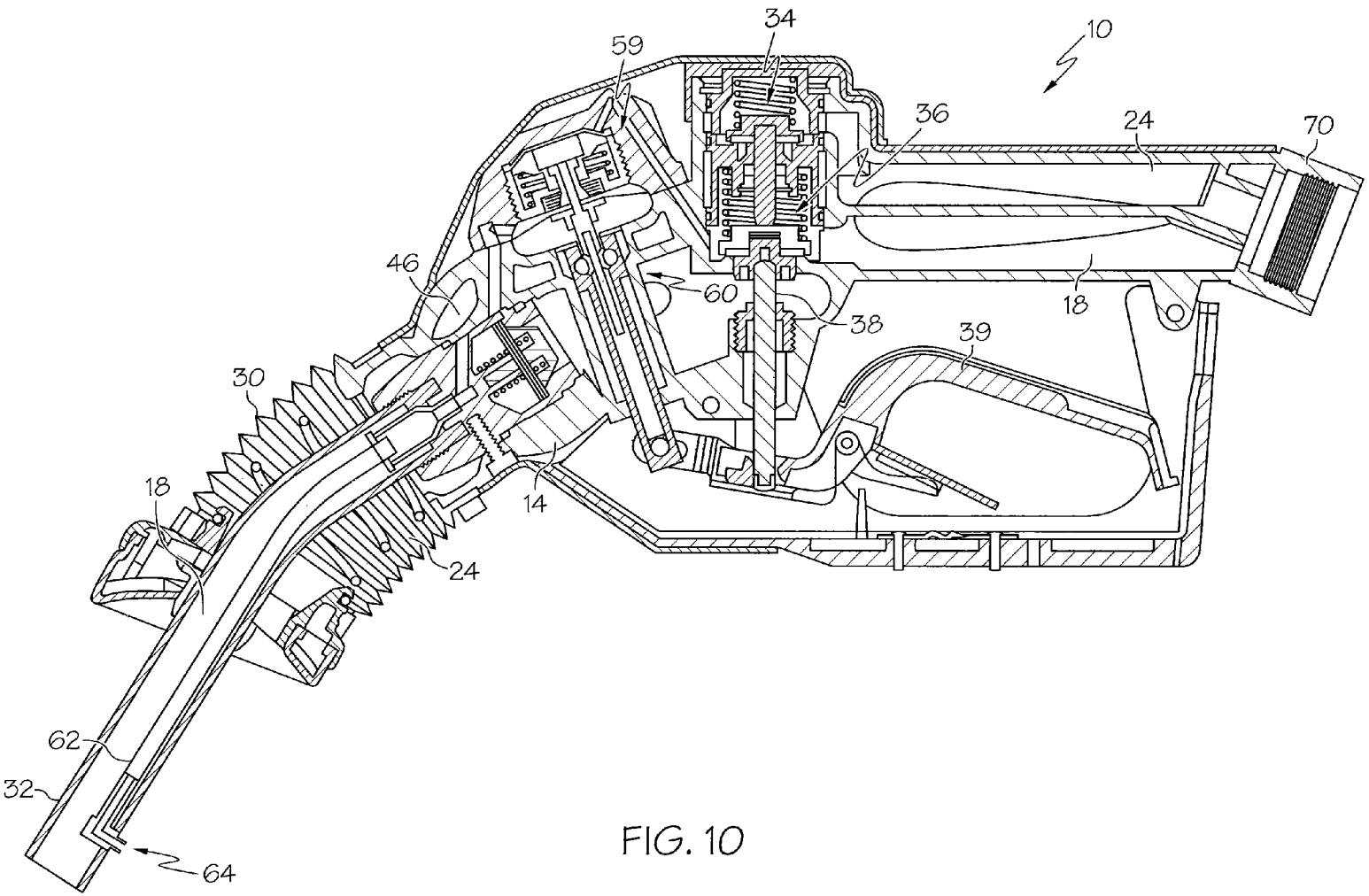
FIG. 10 is a cross section taken along line 10-10 of FIG. 4.

The system 10 further includes a shutoff circuit 60 (FIGS. 2, 3 and 10) including a shutoff tube or conduit 62 which is received in the spout 32 and fluidly isolated from the rest of the spout 32. The shutoff conduit 62 terminates in an opening 64 on the outer surface of the spout 32 that is exposed to pressure/vacuum in the inner volume of the vapor boot 30. The upper or distal end of the shutoff conduit 62 is coupled to a shutoff mechanism 59 (FIG. 10). A vacuum created by a venturi effect of flowing fuel may be passed through the shutoff conduit 62. When the opening 64 of the shutoff conduit 62 is temporarily blocked or closed (i.e. due to foam or splash back of liquid fuel in the vehicle tank 12) the vacuum levels in the shutoff circuit 62 significantly increase, thereby causing the shutoff mechanism 59 to release the lever 39 and close the main valves 34, 36 thereby temporarily interrupting the fueling process.

When it is desired to refuel a vehicle, the spout 32 is inserted into the fill pipe 15 of a vehicle, such that the vapor boot 30 also contacts, or is in close proximity with, the vehicle fill pipe 15 to thereby generally seal the inner volume of the vapor boot 30 (for the purposes of this application, the fill pipe 15 is considered to be part of the vehicle tank 12). The lever 39 is then gripped by the customer/operator and pivoted upwardly, thereby opening the main vapor valve 34 and main fuel valve 36. Fuel is pumped by the fuel pump 22 and flows from the underground storage tank 20 towards the vehicle tank 12, as indicated by the arrows in the fuel path 18 of FIG. 2. Refueling fuel passes through a check valve 68 and into the vehicle tank 12.

When refueling a non-ORVR vehicle not experiencing vapor collapse, fuel flows through the fuel path 18 and into the vehicle tank 12, as indicated by the arrows in the fuel path 18 of FIG. 2. Simultaneously, vapor is exhausted out of the vehicle fuel tank 12, and flows out of the fill pipe 15, into the vapor boot 30, and enters vapor path 24 of the refueling system 10 as indicated by the arrows in the boot 30 of FIG. 2. The vapor then flows past the open sensing valve 40, through the intermediate path 46, past the open regulator valve 42, through the hose 16 and to the ullage space 26 of the underground storage tank 20. Some amount of fresh air from the vent path 48 may enter the vapor path 24 via the primary vent 50 and always open secondary vent 52, which introduces a limited amount of fresh air into the underground storage tank 20. However, the amount of air from the vents 50, 52 is restricted by the orifice size of the vents 50, 52 to prevent over-pressurization of the underground storage tank 20, which minimizes the escape of vapors from the storage tank 20.

The vapor pump 28 may apply a negative pressure to the vapor path 24 to aid in the evacuation of vapors from the vehicle tank 12. The vacuum applied by the vapor pump 28 can vary as desired, but one embodiment may range between about—20 and about—120 inches water column gage (measured when the vapor pump 28 is dead-headed). The vents 50, 52 allows the inward or outwardly flow of air/vapor, and helps to reduce pressure or vacuum spikes in the vapor path 24. For example, should the vapor pump 28 or other systems cause a sudden change in pressure in the vapor path 24, the vents 50, 52 alleviate the pressure/vacuum spikes somewhat, which helps to avoid undesired closing of valves and reduces wear and tear on the system components.

Fuel flowing into the vehicle tank 12 may create a slight negative pressure (i.e. about—1 to about—3.5 inches of water column gage) due to the venturi effect, even for non-ORVR vehicles, which vacuum can be somewhat exerted on the sensing valve 40 and/or regulator valve 42. In addition, some pressure from the vapor pump 28 may be exerted on the sensing valve 40 and/or regulator valve 42 (although the pressure exerted on the valves 40, 42 in their open positions is typically significantly less than the total vacuum generated by the vapor pump 28 due to the distance of the valves 40, 42 from the vapor pump 28, fresh air introduced from the vents 50, 52, and the dynamic (as opposed to static) nature of the applied vacuum pressure).

Accordingly, the sensing valve 40 and regulator valve 42 should each have a sufficiently stiff spring 51 and/or sufficient preload force (installed force) to resist the combined vacuums of the vapor pump 28 and any venturi effect from refueling a non-ORVR vehicle. Moreover, as briefly described above, because the regulator valve 42 has a higher spring stiffness and/or preload force than the sensing valve 40, as long as the sensing valve 40 does not close, the regulator valve 42 will not close.

The regulator valve 42 may regulate or control the vacuum applied by the vapor pump 28. For example, in one embodiment the regulator valve 42 is configured to regulate the vacuum applied by the vapor pump 28 between about a pair of threshold valves. More particularly, when the vacuum applied by the vapor pump 28 increases over a first threshold value (i.e. about—20 inches water column gage in one embodiment) the regulator valve 42 shifts away from its fully open position (due to vacuum forces exerted thereon), thereby restricting the vacuum in the intermediate path 46 and reducing the vacuum applied to the sensing valve 40. If the pressure applied by the vapor pump 28 increases above a second threshold (i.e. about—30 inches water column in one embodiment, or about—40 inches water column in another embodiment) the regulator valve 42 moves to its fully closed position. In this case, the intermediate path 46/and sensing valve 40 are generally isolated from the vapor recovery pump 28, although some vacuum from the vapor pump 28 may be applied to the intermediate path 46/sensing valve 40 across the leakage path 58 of the regulator valve 42. In this manner, the regulator valve 42 maintains a vacuum on the sensing valve 40 within a desired ranged.

Besides maintaining a desired vacuum range on the sensing valve 40, the regulator valve 42, together with the vents 50, 52, may provide the additional benefit of regulating pressure in the vapor boot 30 to avoid premature nozzle shutoffs. In particular, as noted above, the opening 64 of the shutoff conduit 62 is positioned in the vapor boot 30, and can communicate a vacuum from the fill pipe/bellows interface to the nozzle automatic shutoff diaphragm (i.e. in one embodiment, about—13 inches water column gage vacuum will shift the automatic shutoff diaphragm). During a vapor collapse event, the vapor collapse occurring in the vehicle tank 12 may apply a vacuum which, in combination with the vacuum from the vapor pump 28, is sufficiently high to trigger automatic shutoff. However, in the embodiment shown in FIG. 2, the regulator valve 42 and vents 50, 52 control the vacuum applied by the vapor pump 28 to ensure vacuum levels in the bellows 30 do not reach a sufficiently high level to trigger the shutoff circuit 60. Moreover, since the vent path 48 is in direct communication with the inner volume of the bellows 30, a direct control of pressure in the bellows 30 is provided.

In sum, in the vapor recovering state shown in FIG. 2, both valves 40, 42 are biased open to allow vapor from the vehicle fuel tank 12 to travel to the underground storage tank ullage space 26. Although the vapor path 24 is diverted a bit (i.e. by passing through the valves 40, 42 and the intermediate path 46), the pressure drop or vapor flow resistance through those components is believed to be within about +/−5% of existing vacuum assist nozzles. Thus, vapor recovery in the system of FIG. 2 provides a refueling system 10 that has substantially the same performance in many parameters as standard vacuum assist vapor recovery nozzles, but also provides several advantages.

FIG. 3 illustrates the system of FIG. 2 when vapor recovery of the refueling system 10 is blocked. In particular, during refueling the vehicle ORVR fill pipe applies a vacuum (i.e. typically between about—6 and—20 inches water column gage, but could be up to −30 inches or—40 inches water column gage or more) to the vapor boot 30/sensing valve 40. The sensing valve 40 is configured to close when exposed to the vacuum applied by ORVR refueling, in addition to any vacuum applied by the vapor pump 28. For example, the sensing valve 40 may be configured to close when exposed to a pressure in the bellows 30 of between about—4 and about −5 inches of water column gage.

When the sensing valve 40 is closed, the vacuum applied by the vapor pump 28 is essentially entirely closed or "dead-headed" at the sensing valve 40, thereby causing significantly increased vacuum pressure (i.e. substantially the entire vacuum force of the vapor pump 28) to be applied to the regulator valve 42. This high vacuum force thereby causes the regulator valve 42 to shift from its open position, to a fully or partially closed position, depending upon the vacuum applied by the vapor pump 28. The valves 40, 42 are shown in their closed positions in FIG. 3.

As noted above, the bellows 30 may be generally continuous, and lack any holes or vents formed therein (i.e. holes or vents having a total surface area of greater than about 0.15 $mm^2$). The closed nature of the bellows 30 may help to improve the sensitivity of the sensing valve 40. In particular, if the bellows 30 were to be vented, the vacuum of the ORVR system would be diluted by air pulled through the vents in the bellow 30, thereby making the presence of the ORVR system be more difficult to detect. In the present system, the sensing valve 40 may be able to more easily sense the ORVR system, and then close accordingly.

When the sensing 40 and regulator 42 valves are closed, the vehicle fill pipe 15 is generally fluidly isolated from the vacuum generated by the vapor pump 28. However, because the vapor pump 28 continues to operate, some vapor/air is pulled across the leakage paths 58 of the sensing valve 40 and the regulator valve 42. Fresh air also enters into the vent path 48 by the vents 50, 52. Moreover, since the regulator valve 42 is typically fully or partially closed during ORVR refueling, the always open secondary vent 52 is more fully opened, which allows additional air to enter the vent path 48 through the always open secondary vent 52 than during non-ORVR refueling. Restricted amounts of fresh air may thus flow to the vapor pump 28/underground tank 20 across the leakage paths 58 of the valves 40, 42. However, the vents 50, 52 and/or leakage paths 58 may be sized to allow only a limited amount of fresh air to flow to the vapor pump 28/underground tank 20 during non-ORVR refueling.

As noted above, the regulator valve 42 is a normally open valve which regulates the vacuum applied by the vapor pump 28 such that the pressure in the intermediate path 46 is regulated between a pair of threshold values (i.e. about—20 inches and about—30 inches water column gage in one case). In this manner, the regulator valve 42 shields the sensing valve 40 from the additional vacuum provided by the vapor pump 28 when vapor recovery is blocked. In other words, the regulator valve 42 ensures that somewhat of equilibrium is maintained across the sensing valve 40 to allow the sensing valve 40 to re-open, as necessary, at the end of the vapor collapse event, as will be described in greater detail below. In addition, the regulator valve 42 works in conjunction with the primary vent 50 and the always open secondary vent 52 to ensure that the vacuum in the vapor boot 30 is controlled and is not so large so as to trip the automatic shutoff circuit, in a similar manner to that described above in the context of FIG. 2.

As noted above, the vehicle being refueled may experience "vapor collapse" in which the vehicle experiences a vacuum in the fuel tank 12 during initial refueling, causing a non-ORVR vehicle to temporarily exhibit the characteristics of an ORVR vehicle. The vacuum levels created by vapor collapse may vary, but in one embodiment the vacuum created in the bellows 30 may be at least about 3 inches, or at least about 5 inches, water column vacuum. However, as also noted above, in vapor collapse, the negative pressure applied to the inner volume of the vapor boot 30 quickly dissipates, and therefore vapor recovery from the refueling system 10 is again needed after vapor collapse. The refueling system 10 of the present invention has the capability to switch from a non-vapor recovery state (shown in FIG. 3) to a vapor recovery state (shown in FIG. 2) to thereby account for vapor collapse conditions.

When the sensing valve 40 is in the closed position shown in FIG. 3, the sensing valve 40 is exposed to two separate vacuum sources. The major surface area 54*b* of the diaphragm 54 of the sensing valve 54 is primarily exposed to the vacuum of the inner volume of the vapor boot 30, and the minor surface area 54*a* of the diaphragm 54 is exposed to the vacuum from the vapor pump 28, as regulated by the regulator valve 42. For example, during vapor collapse, the major surface area 54*a* of the sensing valve 40 may be exposed to between about—5 and about—6 inches of water column gage, and the minor surface area 54*b* and may be exposed to about—20 and about—30 inches of water column gage (as regulated by the regulator valve 42). When the vacuum pressure on the major surface area 54*b* of the sensing valve 40 drops to zero (i.e. the vapor collapse event ends), the remaining vacuum on the minor surface area 54*b* of the valve 40 (i.e. the regulated pressure of the vapor pump 28) is insufficient to overcome the spring force of the valve 40, and the valve 40 shifts to its open position.

Similarly, when the regulator valve 42 is closed, the major surface area 54*b* of the regulator valve 42 is exposed to regulated vacuum pressure (i.e. the pressure in the intermediate path 40), and the minor surface area 54*a* is exposed to the vacuum generated by the vapor pump 20. Once the sensing valve 40 shifts to its open position (i.e. at the end of a vapor collapse event), the major diameter 54*b* of the regulator valve 42 is exposed to the pressure (i.e. either a positive or negative pressure) in the inner volume of the vapor boot 30 and the intermediate path 46, which is typically less than the regulated pressure in the intermediate path 46. The reduction in pressure on the major diameter 54*b* of the regulator valve 42 causes the regulator valve 42 to shift to its open position, thereby providing unblocked flow of the vapor past the opened valves 40, 42 to the underground storage ullage space 26.

In this manner, the system 10 can move from the non-vapor recovery state shown in FIG. 3 to the vapor recovery state shown in FIG. 2 upon the termination of a vapor collapse event during the same refueling event, and without interrupting the flow of fuel, and without having to reset the system 10. The regulator valve 42 thus allows the sensing valve 40 to shift in position, as desired, to thereby allow the system 10 to accommodate "false positives" for ORVR vehicles which may be provided by a hot vehicle/vapor collapse condition. Moreover, should the ORVR system of a vehicle fail for certain reasons during refueling the system 10, the system 10 may be able to switch from a non-vapor recovery state to a vapor recovery state to thereby recover vapors as desired. In addition, should the sensing valve 40 fail for some reason during ORVR refueling, the ORVR system 10 would likely generate a sufficient vacuum to trigger the shutoff circuit 60. Thus, the system 10 may be a fail-safe system with respect to the sensing valve 40 during ORVR refueling.

The sensing 40 and regulator valves 42 are placed upstream of the main vapor valve 34 such that the sensing 40 and regulator 42 valve are not positioned between the main vapor valve 34 and the vapor pump 28. In this manner, when the main vapor valve 34 is closed, the sensor 40 and regulator 42 valves are isolated from any positive and negative pressures induced by the vapor recovery system. This, in turn, helps to reduce fatigue of the valves 40, 42 and degradation of the valves 40, 42 due to exposure to vapors in the tank 20. In addition, since the valves 40, 42 each include leakage paths 58 (and the regulator valve 42 is associated with the always open secondary vent 52), by positioning the valves 40, 42 upstream of the main vapor valve 34, undesired vapor emissions or fresh air intake through the valves 40, 42 via the tank 20 are avoided when the main vapor valve 34 is closed. Moreover, the placement of the sensing 40 and regulator 42 valves closer to the spout end 32 of the nozzle 14 increases reaction time and sensitivity of the valves 40, 42.

The vents 50, 52 of the vent path 48 are in direct communication with the inner volume of the bellows 30. As noted above, the vents 50, 52 help to dilute pressure spikes in the system, and also help to avoid premature shutoffs due to triggering of the shutoff circuit 60. However, vents 50, 52 also help to avoid conditions in which the shutoff circuit 60 fails to function due to over pressurization. In particular, if the system 10 is operating in the non-vapor recovery state of FIG. 3 and the vehicle is, in fact, not an ORVR vehicle (or the ORVR system fails), if there is some failure in the system the sensing valve 40 may not shift back to its open position as desired. In this case, the pressure in the vehicle tank 12 and bellows 30 would increase due to the influx of fuel in the vehicle tank 12 with no exhaust port for the vapor. The increased pressure may be transferred to the automatic shutoff diaphragm through the shutoff conduit 62. In this case, the shutoff circuit 60 may not operate in its intended manner.

To address this situation, the primary vent 50 and the always open secondary vent 52 allow pressurized vapor to escape the vapor path 24 to ensure proper operation of the shutoff circuit 60. For example, in many cases the shutoff circuit 60 needs a pressure differential of at least about 15 inches water gage to shutoff the fueling event. The vents 50, 52 may be configured to ensure that the system 10 can provide at least the desired pressure differential to ensure proper operation of the shutoff circuit 60.

The intermediate portion 24 may lack any valves between the sensing valve 40 and the regulator valve 42 which can block or restrict the flow of vapor through the vapor path 24 to ensure proper operation of the sensing valve 40 and regulator valve 42. In particular, this arrangement allows the regulator valve 42 to directly regulate the pressure on the sensing valve 40, without any intervening valves/control components. Moreover, the sensing 40 and regulator 42 valves may be generally isolated from any pressure generated by fuel flow such that those valves 40, 42 are responsive only to vapor pressure. In fact, the entire system 10 may lack any valves or other control components that control the flow of vapor that are operated by, or responsive to, pressure of fuel. In this manner the vapor recovery system is generally isolated from the fuel path 24 to avoid leaks and avoid pressure disruptions of each system.

Figure 6:
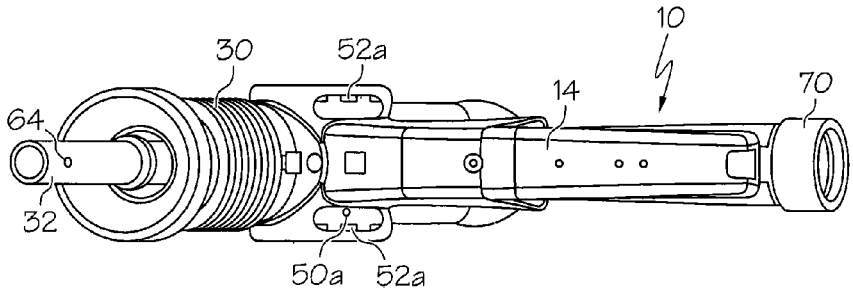
FIG. 6 is a bottom view of the nozzle of FIG. 4.
Figure 7:
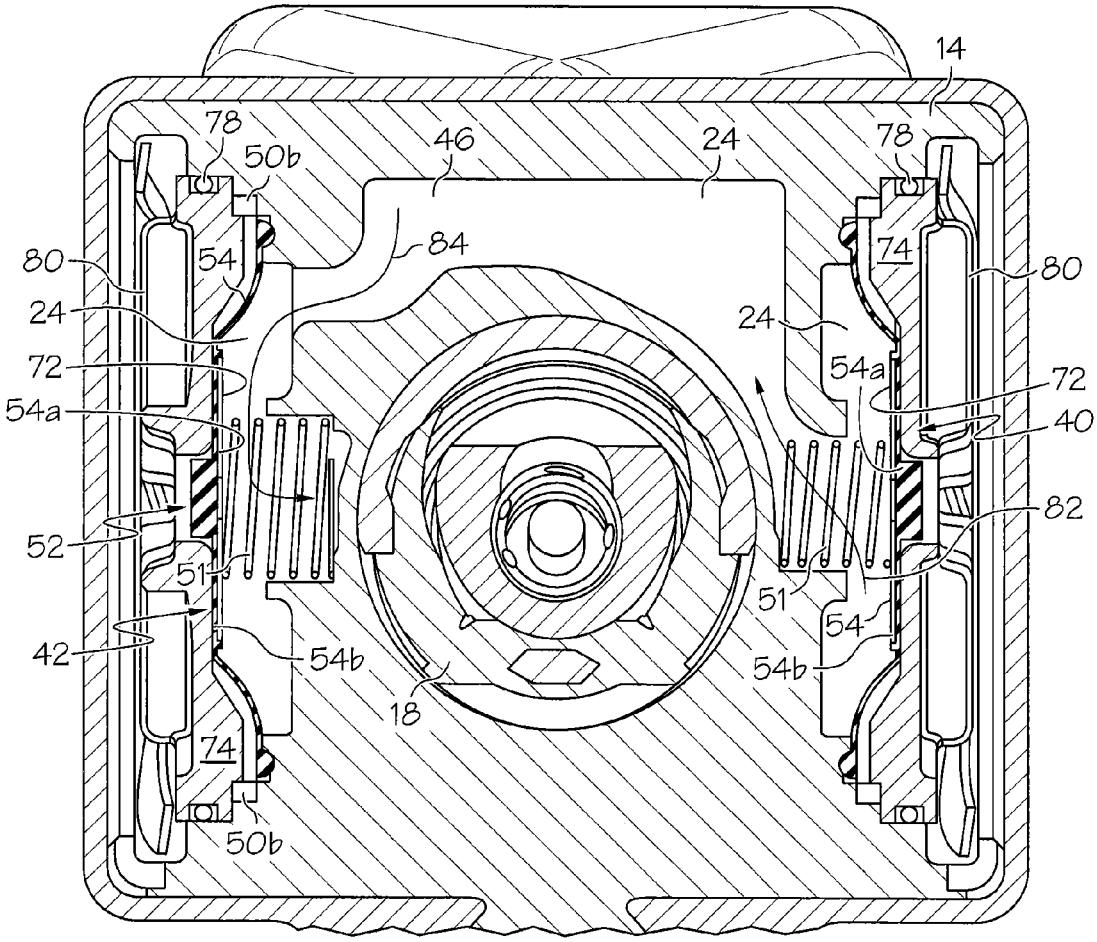
FIG. 7 is a cross section taken along line 7-7 of FIG. 5.
Figure 8:
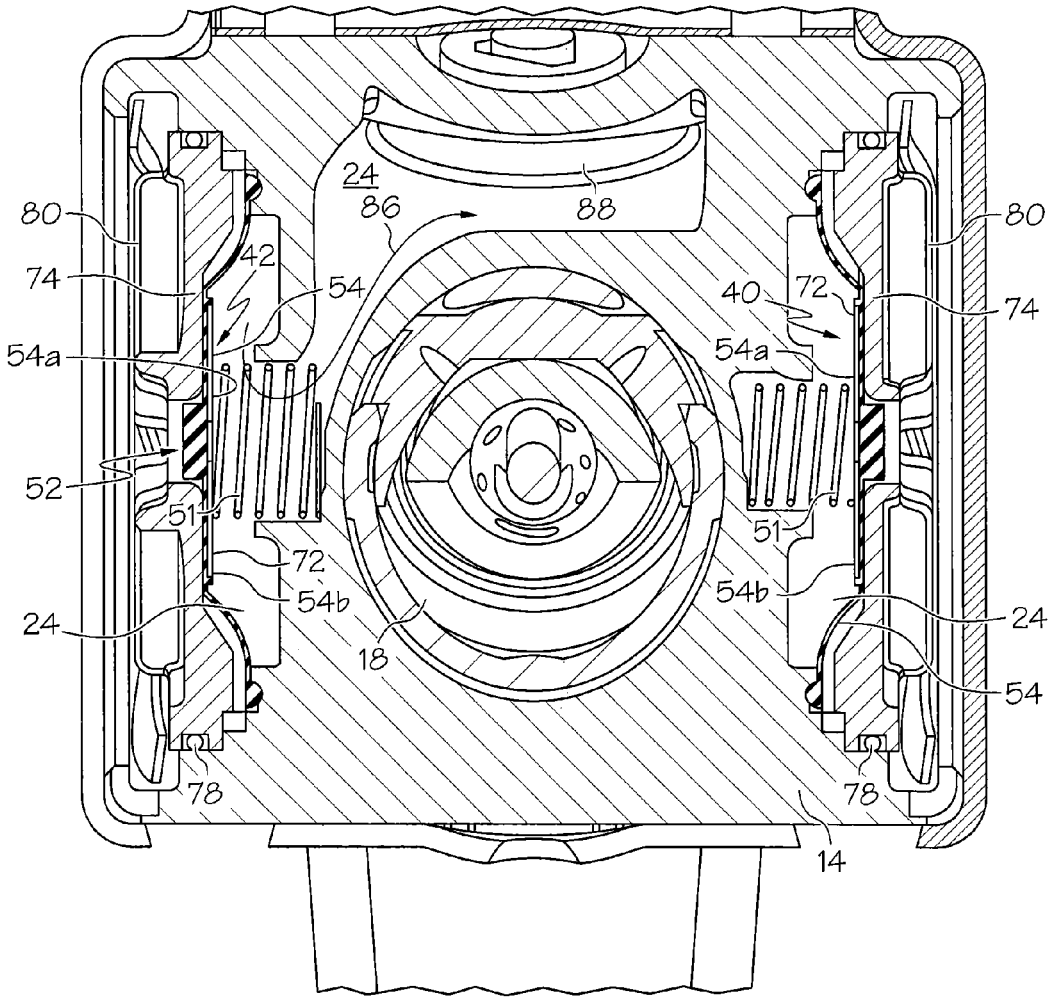
FIG. 8 is a cross section taken along line 8-8 of FIG. 5.
Figure 9:
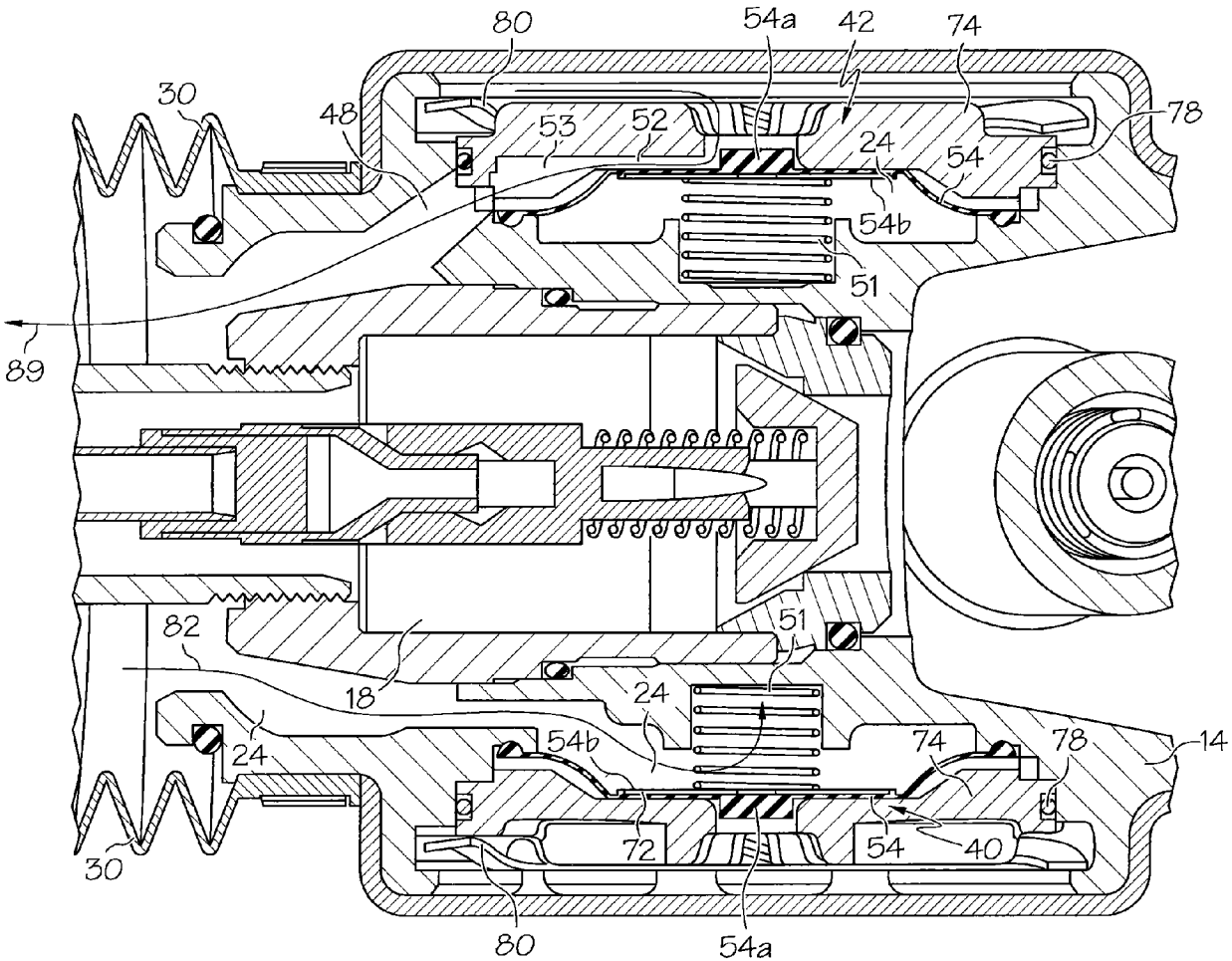
FIG. 9 is a cross section taken along line 9-9 of FIG. 5.

FIGS. 4-10 illustrate one embodiment of a fuel nozzle 14 in which the system of FIGS. 2 and 3 is implemented or embodied. It can be seen that the nozzle body/dispenser body 14 may include the spout 32, bellows 30 and handle/lever 39 coupled thereto. The nozzle 14 includes a hose interface 70 to which the hose 16 is designed to be coupled. As best shown in FIGS. 7-9 the sensing valve 40 and regulator valve 42 are, in illustrated embodiment, positioned on outer opposite sides of the nozzle 14.

The diaphragm 54 of each valve 40, 42 may be of the same material and design to decrease part count for ease of manufacturing and repair. For example, in one embodiment each diaphragm 54 is made of FKM fluorinated elastomer rubber having a hardness of about sixty durometer molded over a stainless steel insert 72. However, the diaphragm 54 can be made of nearly any compatible elastomer material, including (but not limited to) VITON® GFLT material sold by DuPont Performance Elastomers, LLC, of Wilmington, Del., or nitrile N1502. Each insert 72 provides a corrosion resistant support against which the springs 51 can press. Each diaphragm 54 may incorporate a convolute for increased stroke and decreased internal stresses of the diaphragm 54. Each valve 40, 42 may include a cap 74 which covers and holds the associated diaphragm 54 in place. Each cap 74 is sealed with an o-ring 78 to prevent any uncontrolled leaks so that any venting in the vapor path 24 occurs solely through the primary vent 50 and the always open secondary vent 52, as desired. Each cap 74 is retained in place by a wave-retaining ring 80 which acts as a spring and supplies a clamping force so that each cap 74 seals against the associated diaphragm 54.

FIGS. 7-9 illustrate each valve 40, 42 in the open position. When closed, each valve 40, 42 seats against an associated valve seat. Arrow 82 of FIGS. 7 and 9 illustrates the path of vapor during vapor recovery from the inner volume of the bellows 30, passing through the open sensing valve 40 and entering the intermediate path 46. Arrow 84 of FIG. 7 illustrates the path of vapor exiting the intermediate path 46, and passing through the open regulator valve 42. Arrow 86 of FIG. 8 shows the path of vapor exiting the intermediate path 46 and flowing through the open regulator valve 42 to passage 88 which exits the rear of the nozzle 14 and is fluidly coupled to the vapor path 24 in the hose 16. Finally, arrow 89 of FIG. 9 illustrates the path of fresh air entering the always open secondary vent 52 and flowing to the inner volume of the vapor boot 30 via the vent path 48.

With reference to FIG. 6, the atmosphere end 50*a* of the primary vent 50 can be seen as a small opening in the underside of the nozzle 14. The opening 50*a* extends to a circumferential opening 50*b* shown in FIG. 7, which is in fluid communication with the vent path 48, as shown in FIG. 9. The atmosphere ends 52*a* of the always open secondary vent 52 can be seen as openings in the underside of the nozzle 14 in FIG. 6. Fresh air entering the always open secondary vent 52 flows from the upper end of the diaphragm 54 of the regulator valve 42 to the inner volume of the bellows 30 via the vent path 48, as shown by arrow 89 in FIG. 9. The cut-out or depression 53 formed in the upper contact surface of the valve 42 ensures that the secondary vent 52 is always open. However, various other means for ensuring that the secondary vent always remains open can be provided, such as providing an obstruction to prevent the diaphragm 54 of the regulator valve 42 from contacting the diaphragm cap 74, or providing a hole through the diaphragm cap 74 of the valve 42, etc.

In this manner, the system 10 of in the present invention can operate as a standard vapor recovery nozzle when fueling non-ORVR vehicles. In addition, the system 10 can sense the presence of ORVR vehicles and regulate the appropriate vacuum levels. The system 10 can also respond to "false positives" generated by non-ORVR vehicles undergoing vapor collapse. The system 10 avoids premature shutoffs and avoids nonshut-off events to provide a system in which safety, functionality, durability and environmental considerations are all improved.

Although the invention is shown and described with respect to certain embodiments, it should be clear that modifications and variations will be apparent to those skilled in the art upon reading the specification, and the present invention includes all such modifications and variations.

What is claimed is:

1. A refueling system comprising:

a nozzle configured to dispense fuel through a fuel path thereof into a vehicle tank, said nozzle including a vapor path configured such that vapor recovered from said vehicle tank during refueling is passable therethrough;

a sensing valve disposed in said vapor path, wherein said sensing valve is configured to generally block the associated part of said vapor path when a sufficient vacuum from said vehicle tank is applied to said sensing valve during refueling; and a regulator valve disposed in said vapor path and arranged in series with said sensing valve, said regulator valve being configured to regulate the level of vacuum applied by a vapor pump to said sensing valve, wherein said nozzle includes a main vapor valve which, when closed, generally blocks the flow of vapor through the associated portion of said vapor path and which, when opened, generally does not block the flow of vapor through the associated portion of the vapor path, and wherein said sensing valve and said regulator valve are both positioned upstream of said main vapor valve relative to the flow of vapor through said vapor path during vapor recovery.

2. The system of claim 1 wherein said regulator valve is positioned downstream of said sensing valve relative to the flow of vapor through said vapor path during vapor recovery.

3. The system of claim 1 wherein said regulator valve is configured to regulate the level of vacuum applied by said vapor pump to said sensing valve such that the vacuum applied by said vapor pump to said sensing valve does not exceed a predetermined level.

4. The system of claim 3 wherein said regulator valve is configured to regulate the level of vacuum applied by said vapor pump to said sensing valve such that when the vacuum applied from said vehicle tank drops below a threshold level, said sensing valve no longer generally blocks the associated part of said vapor path.

5. The system of claim 4 wherein said regulator valve is configured to allow said sensing valve to move to a generally open position, during refueling, at the end of a vapor collapse event in said vehicle tank.

6. The system of claim 1 wherein said regulator valve is generally fluidly isolated from the pressure of any fuel flowing through said fuel path.

7. The system of claim 1 wherein said sensing valve and regulator valve are both housed in said nozzle.

8. The system of claim 1 further comprising a vapor pump coupled to a downstream end of said vapor path to enable recovery of vapors through said vapor path when said vapor pump is operated, and wherein the system further comprises a vehicle tank receiving said nozzle therein.

9. The system of claim 1 wherein said sensing valve and said regulator valve are both biased into open positions to allow the flow of vapor though the associated part of the vapor path, and are movable to closed position to generally block the flow of vapor through the associated part of the vapor path.

10. The system of claim 9 wherein when said sensing valve is in said closed position said sensing valve is configured to allow some limited leakage thereacross, and wherein when said regulator valve is in said closed position said regulator valve is configured to allow some limited leakage thereacross.

11. The system of claim 1 further comprising an always open primary vent in fluid communication with said vapor path at a position upstream of said sensing valve relative to the flow of vapor through said vapor path during vapor recovery, wherein said primary vent is open to atmosphere.

12. The system of claim 1 further comprising an always open secondary vent operatively coupled to said regulator valve and configured such that when said regulator valve at least partially closes to regulate the level of vacuum applied by a vapor pump to said sensing valve, said always open secondary vent is more fully opened.

13. The system of claim 12 wherein said always open secondary vent is open to atmosphere and is in fluid communication with said vapor path at a position upstream of said sensing valve relative to the flow of vapor through said vapor path during vapor recovery.

14. The system of claim 1 said sensing valve and said regulator valves are both diaphragm valves, wherein when each valve is closed each valve generally blocks the flow of vapor through the associated portion of the vapor path, and wherein when each valve is closed at least one side of each diaphragm is exposed to two portions of said vapor path which are generally fluidly isolated from each other.

15. The system of claim 1 wherein said nozzle includes a spout and a bellows generally receiving a base end of said spout therein, said bellows being configured to generally form a seal around said spout when said spout in inserted into the fuel tank or fill pipe of a vehicle, and wherein said bellows is generally continuous and lacks any vents or openings formed therethrough.

16. The system of claim 1 wherein said regulator valve is configured to directly regulate the level of vacuum applied by a vapor pump to said sensing valve.

17. The system of claim 1 wherein said system lacks any valves in said vapor path positioned between said sensing valve and said regulator valve which can block or restrict the flow of vapor through said vapor path such that said regulator valve is configured to directly regulate the level of vacuum applied by a vapor pump to said sensing valve.

18. The system of claim 1 wherein said sensing valve is configured to close when said sufficient vacuum is sensed by said sensing valve, in addition to any vacuum applied to said sensing valve by said vapor pump.

19. The system of claim 1 wherein said sensing valve is configured to generally block the associated part of said vapor path when a sufficient vacuum from said vehicle tank is applied to said sensing valve in addition to a vacuum applied to said sensing valve by a vapor recovery pump.

20. The system of claim 1 wherein said sensing valve is configured to close, and thereby generally block the associated part of said vapor path, when a vacuum applying a suction force of less than about 5 inches of water column gage from said vehicle tank is applied to said sensing valve in addition to a vacuum applied to said sensing valve by a vapor recovery pump.

21. A refueling system comprising:

a nozzle configured to dispense fuel and including a vapor recovery path;

a sensing valve disposed in said vapor recovery path, wherein said sensing valve is configured to generally block the associated part of said vapor recovery path when a sufficient vacuum is applied to the sensing valve; and a regulator valve disposed in said vapor recovery path, said regulator valve being configured to regulate the level of vacuum applied by a vapor pump to said sensing valve to adjust the sensitivity of said sensing valve to an external vacuum applied to said sensing valve, wherein said nozzle includes a main vapor valve which, when closed, generally blocks the flow of vapor through the associated portion of said vapor path and which, when opened, generally does not block the flow of vapor through the associated portion of the vapor path, and wherein said sensing valve and said regulator valve are both positioned upstream of said main vapor valve relative to the flow of vapor through said vapor path during vapor recovery.

22. The system of claim 1 further including a manually operable lever coupled to said nozzle, and wherein said main vapor valve is operatively coupled to said lever.

23. A refueling system comprising:

a nozzle configured to dispense fuel through a fuel path thereof into a vehicle tank, said nozzle including a vapor path configured such that vapor recovered from said vehicle tank during refueling is passable therethrough;

a sensing valve disposed in said vapor path, wherein said sensing valve is configured to generally block the associated part of said vapor path when a sufficient vacuum from said vehicle tank is applied to said sensing valve during refueling; and a regulator valve disposed in said vapor path and arranged in series with said sensing valve, said regulator valve being configured to regulate the level of vacuum applied by a vapor pump to said sensing valve, wherein said system lacks any valves in said vapor path positioned between said sensing valve and said regulator valve which can block or restrict the flow of vapor through said vapor path such that said regulator valve is configured to directly regulate the level of vacuum applied by a vapor pump to said sensing valve.

24. The system of claim 21 wherein said nozzle includes a fuel path, and wherein said sensing valve and said regulator valves are both generally fluidly isolated from a pressure of any fuel flowing through said fuel path, and wherein the system lacks any adjustable valves in said vapor recovery path positioned between said sensing valve and said regulator valve which can block or restrict the flow of vapor through said vapor path.

25. The system of claim 21 further comprising a vent in fluid communication with said vapor recovery path at a position upstream of said sensing valve relative to the flow of vapor through said vapor path during vapor recovery, wherein said vent is always open to atmosphere.

26. The system of claim 21 wherein said regulator valve is positioned downstream of said sensing valve relative to the flow of vapor through said vapor path during vapor recovery.

27. A method for dispensing fuel and operating a vapor recovery system comprising:

providing a refueling system having a fuel path, a vapor path, a sensing valve disposed in said vapor path, and a regulator valve disposed in said vapor path and arranged in series with said sensing valve, wherein said system includes a main vapor valve which, when closed, generally blocks the flow of vapor through the associated portion of said vapor path and which, when opened, generally does not block the flow of vapor through the associated portion of the vapor path, and wherein said sensing valve and said regulator valve are both positioned upstream of said main vapor valve relative to the flow of vapor through said vapor path during vapor recovery;

allowing fuel to flow through said fuel path into a vehicle tank;

allowing a vacuum to be applied to said vapor path by a vapor recovery pump to aid in the recovery of vapor emitted by said vehicle tank during said first allowing step;

closing said sensing valve in response to a vacuum generated in said vehicle tank such that said sensing valve generally blocks the associated part of said vapor path; and operating said regulator valve to regulate the vacuum applied to said sensing valve by said vapor recovery pump such that said sensing valve is movable to away from said closed position when the vacuum generated in the vehicle tank dissipates.

28. The method of claim 27 wherein said vacuum generated in said vehicle tank is a vacuum generated by a vapor collapse event.

29. The method of claim 28 further comprising the step of said sensing valve moving away from said closed position into an open position such that said sensing valve generally does not block the associated part of said vapor path, wherein said moving step occurs when the vacuum generated in the vehicle tank sufficiently dissipates, and wherein said closing and moving steps both occur while fuel flows through said fuel path into said vehicle tank in an uninterrupted manner.

30. The system of claim 22 wherein the system further includes a main fuel valve which, when closed, generally blocks the flow of fuel through the associated portion of said fuel path and which, when opened, generally does not block the flow of fuel through the associated portion of the fuel path, and wherein said main fuel valve is operatively coupled to said lever.

* * * * *